United States Patent [19]

Maura

[11] 4,275,514

[45] Jun. 30, 1981

[54] SNOWPLOW EXTENSIONS

[76] Inventor: Nicholas J. Maura, R.D. #1 Birchwood Dr., Box 192, Duanesburg, N.Y. 12056

[21] Appl. No.: 115,714

[22] Filed: Jan. 28, 1980

[51] Int. Cl.[3] ..... E01H 5/00

[52] U.S. Cl. ..... 37/42 R; 37/50

[58] Field of Search ..... 37/41 R, 42 R, 42 VL, 37/50, 46, 44, 104, 105, 117.5; 172/805, 802, 804, 803, 782, 784, 796, 777

[56] References Cited

U.S. PATENT DOCUMENTS

| | | | |
|---|---|---|---|
| 3,477,151 | 11/1969 | Zanella | 37/42 R |
| 3,604,517 | 9/1971 | Clifford | 37/50 X |
| 3,703,210 | 11/1972 | Williams | 37/50X |
| 3,803,733 | 4/1974 | Ramsey | 37/50 X |
| 3,807,064 | 4/1974 | Schmidt, Jr. | 37/50 X |
| 3,987,562 | 10/1976 | Deen et al. | 37/42 R |
| 4,073,077 | 2/1978 | Essel | 37/50 |

*Primary Examiner*—E. H. Eickholt

[57] ABSTRACT

An attachment for snowplows comprising two sheets of steel, fiberglass, or plastic type material that are curved in contour with the snowplow moldboard and attached thereto in such a manner as to make the snowplow adjustable to various widths.

3 Claims, 2 Drawing Figures

SNOWPLOW EXTENSIONS

BRIEF SUMMARY

The snowplow will be within the legal width limits for road travel and can be extended after arriving at the job site. The attachment can be manufactured and adapted to any size plow. The advantages of this attachment are, first, to save time. A wider blade will push more snow. And second, to reduce wear to the vehicle. A wide blade pushing once is equal to approximately two trips with a conventional snowplow.

An optional attachment to the snowplow extensions are side plates, illustrated in FIG. 1, which attach to each side of the extensions and hold the snow so a larger volume of snow can be moved.

Another optional attachment is a kit to convert the snowplow extensions from manual to hydraulic operation. This is an added convenience because the operator may adjust the width of the snowplow from within the vehicle.

For protection of the snowplow and vehicle it is recommended that this attachment be mounted only on snowplows where the entire moldboard is spring-loaded.

DETAILED DESCRIPTION

Figure 1:
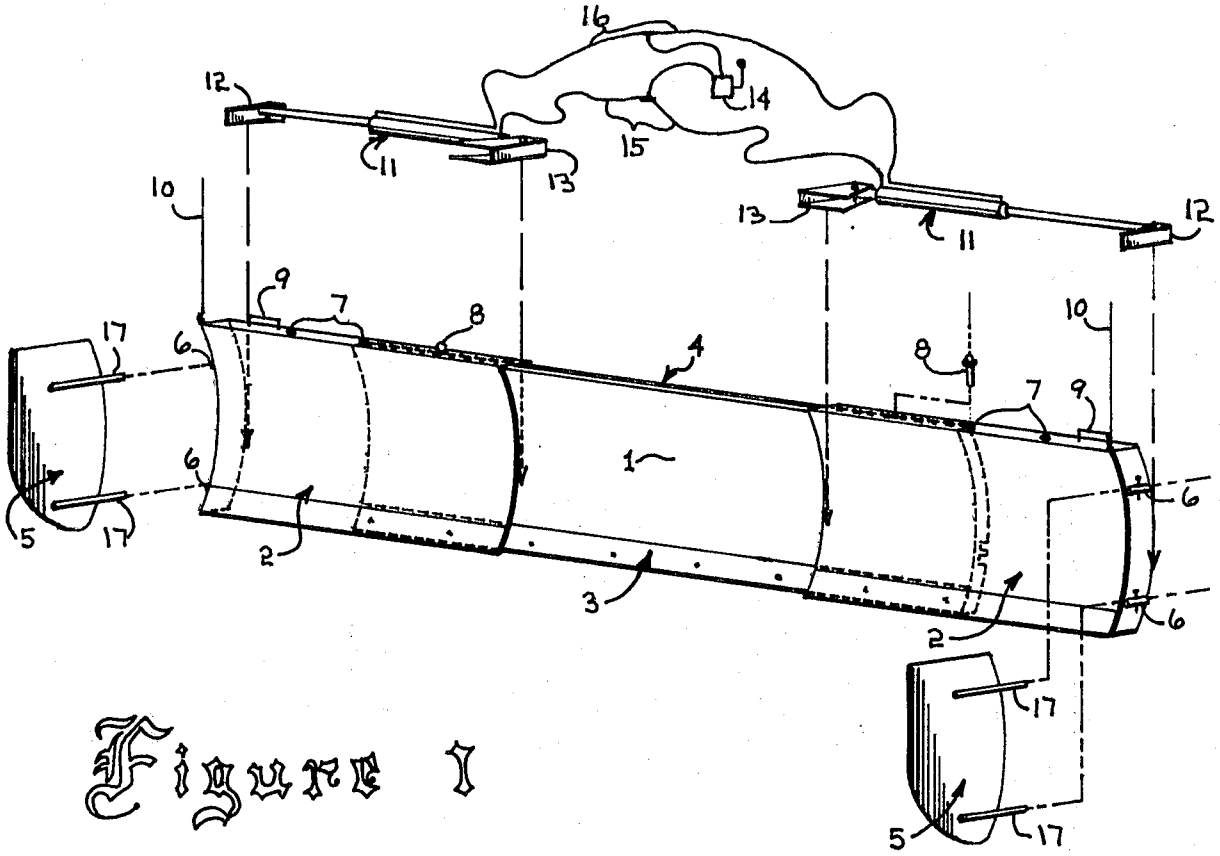
FIG. 1 is a view of a snowplow moldboard provided with the attachments of my invention.

FIG. 1 illustrates a snowplow moldboard 1 with the snowplow extensions 2 in the extended position. Extensions 2 slide on cutter track 3, which is bolted to the snowplow moldboard 1 in place of the existing cutter, and guiding track 4, which is welded to the top of snowplow moldboard 1. Extensions 2, under manual operation, are held in place by adjustment holding pins 8, which extend through guiding track 4. Adjustment holes 7 allow the extensions 2 to be adjustable to various widths. There may be as many adjustment holes 7 as desired to obtain various widths. Handles 9 are mounted to the top of extensions 2 and aid the operator in sliding the extensions. Plow guides 10 are mounted to the outside corners of extensions 2 for operator location of the ends of the plow from within the vehicle. Side plates 5 are an optional added attachment to the extensions 2 for the purpose of holding the snow in front of the blade. Side plates 5 are attached to extensions 2 via side plate attachment bars 17, which are part of side plates 5, and slide through side plate holders 6 and are fastened thereto. For optional hydraulic operation the double action extending cylinders 11 are positioned to the back of snowplow moldboard 1 and extensions 2 as shown by direction arrows in drawing. Adjustment holding pins 8 are not required for hydraulic operation and should not be used. One of the ends of the double action extending cylinders 11 are attached to the backside of the snowplow moldboard 1 via inside mounting brackets 13. The opposite ends of cylinders 11 are attached to the snowplow extensions 2 via outside mounting brackets 12. Oil lines 15 shall junction into a tee and form one oil line behind the moldboard 1, which will connect to the vehicle. Oil lines 16 shall junction into a tee and form one oil line behind the moldboard 1, which will connect to the vehicle. In this way only two oil lines will need to be attached to the vehicle in order for the double action extending cylinders 11 to operate. Two-way control valve 14 will be required to operate the extending cylinders. Control valve 14 shall work in conjunction with existing plow pump and miscellaneous fittings and short lines will be required to attach the hydraulic operation thereto.

Figure 2:
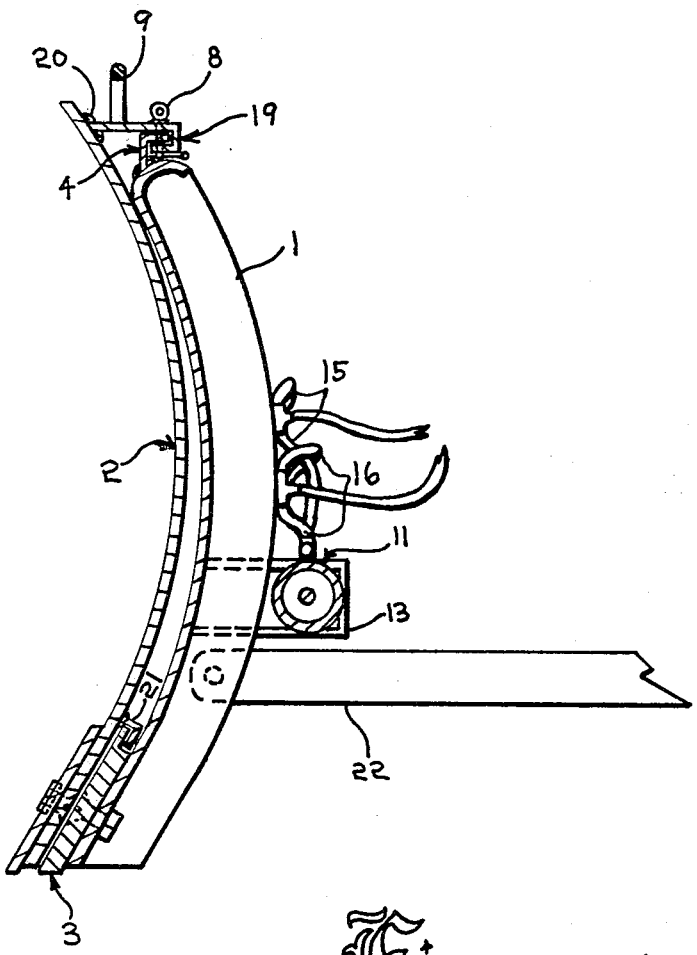
FIG. 2 is a sectional view of a snowplow; from the side position, provided with the attachments of my invention.

FIG. 2 is a sectional view of one side of a snowplow provided with the attachments of my invention. This sectional view is symmetric to both sides of the snowplow. Cutter track 3 bolts to snowplow moldboard 1 in place of the existing cutter. Snowplow extensions 2 slide on cutter track 3 via bottom guide 21, which is welded or bolted to the extensions 2 at the time of manufacturing. Guiding track 4 is welded to the top of the snowplow moldboard 1. Extensions 2 ride in guiding track 4 via top guide 19, which is welded or bolted to the extensions 2 at joint 20. Various heights of snowplows will require joint 20 to vary up or down at extensions 2, depending upon where top guide 19 will slide easily in guiding track 4. For manual operation adjustment holding pin 8 extends through both top guide 19 and guiding track 4 and is fastened. For hydraulic operation double action extending cylinders 11 shall be welded to the snowplow moldboard 1 via inside mounting bracket 13, which shall be positioned in relation to the plow carriage 22 and snowplow moldboard 1 as illustrated in the drawing. Outside mounting bracket 12, which is not illustrated here, but is illustrated in FIG. 1, is positioned and attached in a similar fashion to the extensions.

I claim:

1. A snowplow and snowplow extensions combination comprising:

spring-loaded curved moldboard having a bottom edge and a top edge and a replacement cutter located along said bottom edge with a molded in track extending along the length of said replacement cutter, a guiding track attached to said top edge and having spaced adjustment holes; a pair of extension wings having a top guide slidable engaging said guiding track, a bottom guide slidable engaging said molded in track, said extension wings being curved in contour with said curved moldboard; said top guide having a handle attached for ease in sliding and upright plow guides mounted to the outside corners of said top guide, said top guide having spaced adjustment holes therein, a manual operable position adjustment holding pin for extending through said adjustment holes of said guiding track and top guide when aligned to thereby manually fasten and hold said extension wings in position.

2. The combination recited in claim 1 further comprising side plate holders mounted to outer extension wing sides and receiving a pair of side plates at right angles to said wing sides for holding snow, said side plates having bars extending therefrom for being received by said side plate holders and being held in place by pins extending through said side plate holders and said bars; said side plates having one edge curved in contour with and abutting said extension wings and having another edge rounded on the bottom portion.

3. The combustion recited in claim 1 further comprising a hydraulic power system for sliding said extension wings including double acting hydraulic cylinders mounted to the backside of said snowplow moldboard and having piston rods mounted to said extension wings via mounting brackets attached to said wings, and hydraulic cylinders being operated by a two way control valve connected to said hydraulic cylinders via fluid lines, said valve being adapted to be in fluid communication with an existing vehicle pump to provide power for said double acting cylinders.

* * * * *